US006616292B2

(12) United States Patent
Lin et al.

(10) Patent No.: US 6,616,292 B2
(45) Date of Patent: Sep. 9, 2003

(54) FIBER OPTIC MUSICAL WATER GLOBE

(75) Inventors: Chun-Kuei Lin, Englewood Cliffs, NJ (US); Vincent Lin, Englewood Cliffs, NJ (US)

(73) Assignee: Silk Road Gifts, Carlstadt, NJ (US)

( * ) Notice: Subject to any disclaimer, the term of this patent is extended or adjusted under 35 U.S.C. 154(b) by 0 days.

(21) Appl. No.: 10/209,518

(22) Filed: Jul. 29, 2002

(65) Prior Publication Data

US 2003/0147235 A1 Aug. 7, 2003

Related U.S. Application Data

(60) Provisional application No. 60/355,659, filed on Feb. 6, 2002.

(51) Int. Cl.[7] ..... F21V 3/00

(52) U.S. Cl. ..... 362/101; 362/562; 362/565; 362/806

(58) Field of Search ..... 362/101, 154, 362/253, 363, 554, 555, 562, 565, 806

(56) References Cited

U.S. PATENT DOCUMENTS

| | | | | | |
|---|---|---|---|---|---|
| 3,735,113 | A | | 5/1973 | Stott | |
| 3,749,901 | A | * | 7/1973 | Clough | 240/2 |
| 4,771,902 | A | | 9/1988 | Teng | |
| 5,558,421 | A | * | 9/1996 | Guastella | 362/32 |
| 5,732,492 | A | | 3/1998 | Lin | 40/410 |
| 6,030,273 | A | | 2/2000 | Hsu | 446/267 |
| 6,039,453 | A | | 3/2000 | Wang | 362/101 |
| 6,132,284 | A | | 10/2000 | Lin | 446/267 |
| 6,499,854 | B2 | * | 12/2002 | Chen | 362/101 |

* cited by examiner

*Primary Examiner*—Laura K. Tso
(74) *Attorney, Agent, or Firm*—Woodbridge & Associates PC; Richard C. Woodbridge

(57) ABSTRACT

A water globe includes a programmable, multi-color, fiber optic display that can be synchronized with an audio source. The fiber optic bundle sits in a well where the first end of the bundle receives illumination from a three-color LED and the second end of the optical fibers is held in place by an inner top in such a way that the surface of the inner top produces an attractive changeable, multi-color display.

10 Claims, 4 Drawing Sheets

FIBER OPTIC MUSICAL WATER GLOBE

CROSS REFERENCE TO RELATED APPLICATIONS

This application claims the priority of provisional U.S. application Ser. No. 60/355,659, filed on Feb. 6, 2002 and entitled "Fiber Optic Musical Waterglobe" by C. K. Lin and Vincent Lin, the entire contents and substance of which are hereby incorporated in total by reference.

BACKGROUND OF THE INVENTION

1. Field of the Invention

The invention relates to musical globes, in general, and, more particularly, to a musical water globe having an internal fiber optic display and a novel method of installing and sealing same.

2. Description of Related Art

Water globes have been known for many years. They frequently comprise winter scenes in which the globe is inverted and then turned upright so that artificial snow falls inside on a Santa Claus or religious nativity tabloid, or the like.

A review of the prior art indicates that there are a number of variations on water globes. For example, U.S. Pat. No. 6,039,453 describes a lighted water globe which employs fiber optic strands mounted directly on the surface of a rubber plug. A music box movement is employed to play a tune and rotate the water globe, relative to its base, and a lighting effects wheel which controls the output beam of a light source directed at the input end of the fiber optic strands.

Similarly, U.S. Pat. No. 4,771,902 describes a sealed, water-filled container including a light source, which projects through the globe's sealing structure.

U.S. Pat. No. 3,735,113 describes a structure which incorporates a light source, a battery, and a fiber optic array all fitted into a wine glass body.

In addition, U.S. Patents 6,030,273 and 6,132,284 describe water globes which incorporate music sources and also employ waterproof seals in their bases.

Lastly, U.S. Pat. No. 5,732,492 describes another typical water globe including a special seal arrangement.

While the use of fiber optic displays and audio devices is known, to a limited extent in the water globe art, nevertheless, such devices are moderately difficult to make because the sealing structure has to keep the apparatus from leaking while, at the same time, permitting the fiber optic portion to be effectively supportive, gathered and illuminated by its light source. Because the water globe is typically a consumer item, it is also important to keep the production and assembly costs low. At the same time, the device has to produce a pleasant effect. In so far as understood, there are no water globes presently on the market that satisfactorily meet all of the foregoing criteria. It was the context of the foregoing prior art that the present invention arose.

SUMMARY OF THE INVENTION

Briefly described, the invention comprises a water globe which incorporates an attractive, programmable, multi-color LCD display and which can be operated in synchronism with an audio source of music or other pleasant sounds. The light source preferably comprises a three color LED that is illuminatable in red, green and blue as directed by a solid state controller unit. A speaker is also connected to the controller unit and permits the light show produced by the LED to be synchronized with verbal or musical sounds. The open end of the glove is sealed by a resilient gasket having a sidewall with a rib that impinges on the bottom aperture of the glove. A cover which includes a well for receiving the fiber optic bundles sits in a recess in the resilient seal. The bottom of the well is clear and the LED is held in place underneath the well in such a fashion as to effectively illuminate the bottom ends of the fiber optic fibers. The top ends of the fiber optic fibers pass through an inner top and emerge at the surface at the inner top. The inner top can be contoured into the form of a mountain, cottage, or the like. The well in the cover gathers and supports the illuminated bottom end of the optical fibers and places them in a very close proximity to the LED while the top side of the cover supports the inner top which in turn supports the ends of the fiber optic fibers that the consumer views. A switch on the bottom of the apparatus permits the user to turn on the controller which in turn causes the LED to run through a program which produces lights of various different colors on the surface of the inner top. The controller, at the same time, may control a speaker so that the device might provide an illumination display that is synchronized with holiday music such as "Silent Night", "We Wish You A Merry Christmas", etc. When the power switch is set to one side, changeable colored lights appear on the inner structure, but when the power switch is set to the other side, the multi-colored changeable lights are accompanied by music. The center position of the switch is the "On/Off" position.

The invention may be more fully understood by reference to the following drawings.

DETAILED DESCRIPTION OF THE PREFERRED EMBODIMENT

During the course of this description, like numbers will be used to identify like elements according to the different figures that illustrates the invention.

Figure 1:
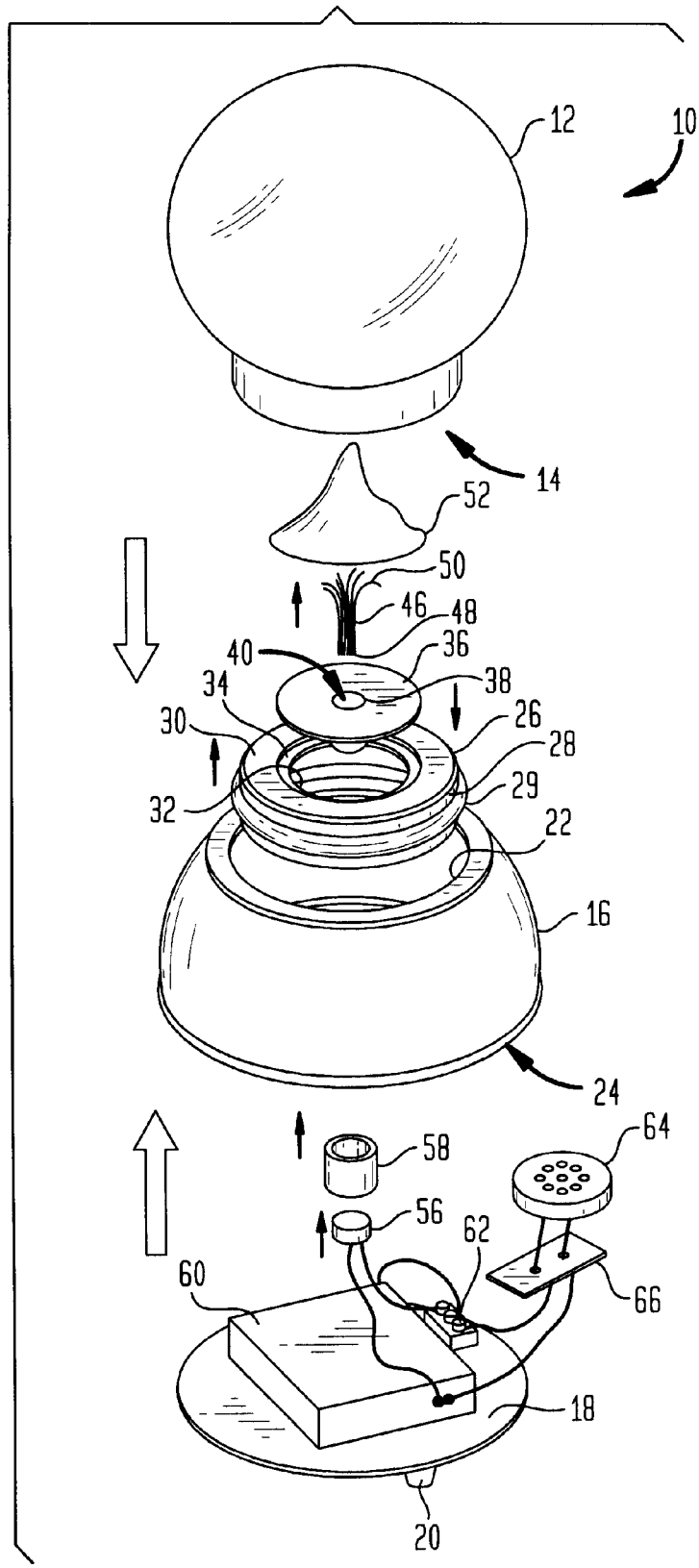
FIG. 1 is an exploded view of the preferred embodiment of the water globe invention.

FIG. 1 is an exploded view of the preferred embodiment of the water globe invention 10. A globe 12, having an open bottom aperture 14, sits on base 16. Base 16 includes a top opening 22 and a bottom opening 24. A bottom plate 18 sits in the bottom opening 24 and includes four (4) rubber feet 20 on the underside thereof. A resilient, rubber like seal 26, which includes a sealing rib 29, sits inside of the bottom aperture 14 of the globe 12 in the manner shown in FIG. 3.

Figure 3:
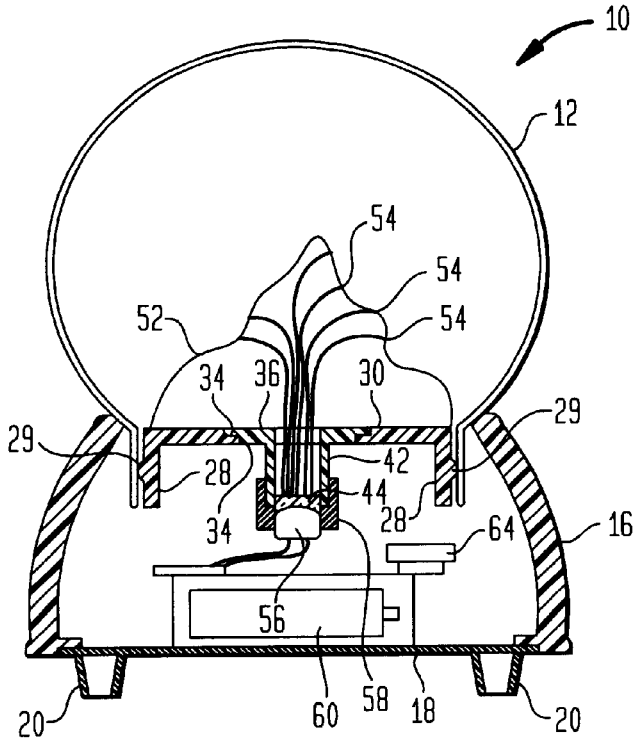
FIG. 3 is an elevational, cross-sectional view of the preferred embodiment of the water globe invention showing in FIGS. 1 and 2.

The resilient seal 26 also includes a flat upper portion 30 having an aperture 32 in the center thereof. A recessed lip 34 resides in the bottom portion of the aperture 32. A cover or plate 36 sits in the aperture 32 and rests on the recessed lip 34. Cover 36 includes a well 40 in the center thereof having a central opening 38, a pair of side walls 42 and a relatively clear bottom section 44, as seen in FIG. 3.

Figure 2:
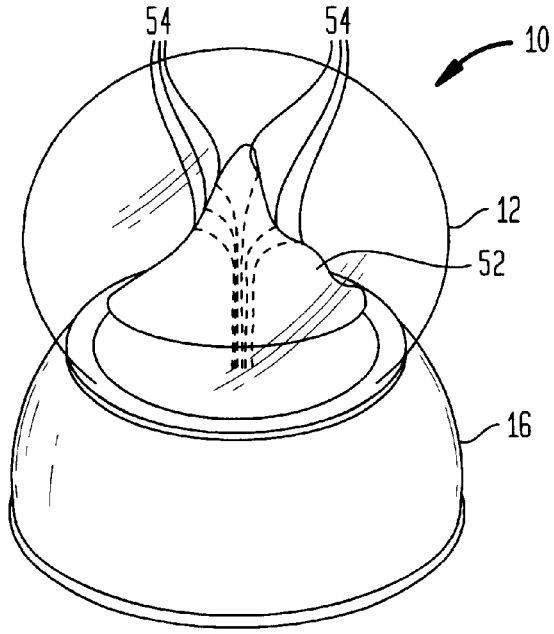
FIG. 2 is an assembled, top perspective view of the preferred embodiment of the water globe invention showing the inner top and base.

A plurality, or bundle, of fiber optic fibers or strands 46 sits in the well 40 and is supported and gathered therein. Each fiber in the fiber optic bundle 46 includes a first, or bottom, end 48 and a second, or, top end 50. The first, or bottom end 48 of the optical fibers 46, rest flush against the clear bottom 44 of the well 40 in close proximity to LED 56. LED 56, in turn, is held in place on the bottom of well 40 by a tight fitting, resilient sleeve 58. The second, or top end, 50 of the fiber optic fibers 46, is supported by an inner top 52. The second ends 50 pass through small holes in the inner top 52 and stop at the top surface of the inner top 52 so that they appear as a plurality of points of light 54, as seen in FIGS. 2 and 3. The shape of the inner top 52 can be that of a mountain, cottage, snow scene, etc.

Figure 5:
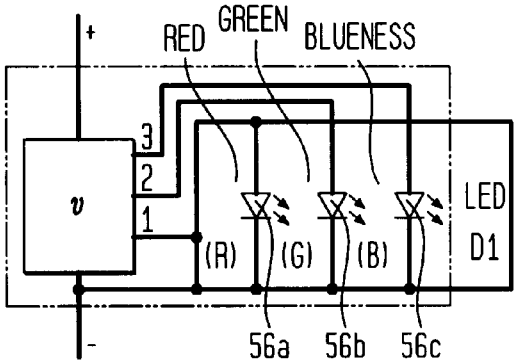
FIG. 5 is an electronic schematic diagram of the programmable, multi-color LED lights.
Figure 6:
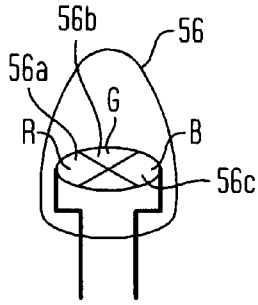
FIG. 6 illustrates the physical structure of the multi-color LED lights.

LED 56 includes a red LED portion 56A, and green LED portion 56B, and a blue or bluish LED portion 56C as shown in the schematic of FIG. 5 and the structural diagram of FIG. 6.

Figure 4:
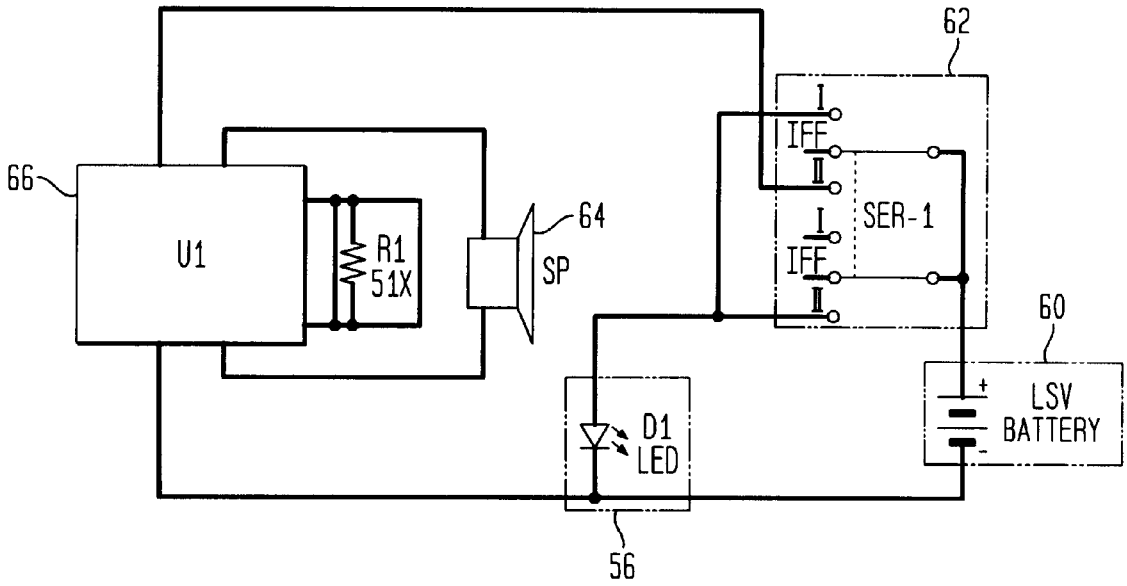
FIG. 4 is a schematic, electronic circuit diagram illustrating the electronic components of the invention.

As seen in FIGS. 1 and 4, the electronic portion of the device 10 primarily consists of the multi-colored, programmable LED 56, a battery complete with battery casing 60, a three (3) position On/Off switch 62, a speaker 64 and an integrated circuit (IC) controller board 66.

The water globe apparatus 10 itself is an attractive item even when the power switch 62 is in the "Off" or middle position. When power switch 62 is turned to one side, changeable colored lights appear on the surface of the inner top 52, but when the power switch 62 is flipped to the other side, the multi-colored, changeable lights are accompanied by, or even synchronized with, music from speaker 64. The integrated circuit (IC) controller board 66 provides the programmed input to the LED 56 and speaker 64 with instructions similar to those shown in FIG. 7.

The water globe invention is typically assembled in the following manner.

Each of the second, or top ends 50 of the fiber optic fibers 46 are passed through holes in the inner top 52 and are attached there with glue, near the surface of the inner top 52, so that they appear at points 54. At the same time the first, or bottom ends 48 of the fiber optic fibers 46 are gathered or combined together in a bundle and placed through the opening 38 of the well 40 so that the first ends 48 abut, or substantially abut, the clear bottom section 44 of the well 40 so as to be in the closest possible proximity to the light emitted by LED 56. The cover 36 is then placed in the aperture 32 so that it sits on the recessed lip 34 of the resilient seal 26 and cemented there with appropriate glue or adhesive. In addition, the first ends 48 which abut the clear bottom 44 of the well 40 are likewise held in place with appropriate cement. The globe 12 is then filled with liquid, preferably a combination of water, anti-freeze and anti-septic, and snowflakes are added as necessary. Shiny decorations are also preferably attached to the inner top 54, which might comprise an object such as a mountain, cottage, etc. Shiny decorations may also comprise free floating flakes on the inside of the globe 12. The inner top 52, previously attached to the rubber seal 26, is placed into the bottom aperture 14 of the globe 12 so that rib 29 contacts the inner sidewall of the bottom opening 14. That entire combination is then placed into the top, or upper, opening 22 of the base 16 and preferably cemented in place therewith. Elastic attachment sleeve 58 is then slipped over the bottom 44 of the well 40 and the LED 56 is, in turn, slipped into the sleeve 58. LED 56 has previously been attached to the battery/battery casing 60. Finally, the package comprising the battery/battery casing 60, speaker 64, "On/Off" switch 62, and IC controller board 66 is attached to the bottom plate 18, which in turn is glued into the opening 24 in base 16.

LED 56 lights up with programmable, multi-colored changeable lights after a pair of AA batteries is installed by accessing the bottom plate 18 and, the "On/Off" switch 62 is activated. Lights shine through the second, or top, end 50 of the fiber optic fibers 46 and appear as points 54. As seen from outside the globe 12, the changeable colored lights sparkle on the surface of the inner top 52. IC controller circuit 66 causes music to play through speaker 64 when the switch 62 is set to the "light+music" position. The water globe invention 10 is an attractive object when the switch 62 is set to the "close" or "off" position, typically the center position, or if the batteries are not installed in the battery casing 60.

As shown in more detail in FIGS. 5 and 6, LED 56 consists of four (4) IC chips, three of which comprise undivided red, green and blue LED regions 56*a,* 56*b* and 56*c*. The fourth IC chip is identified as "U" for IC control. The "U" control IC chip controls the red, green and blue single color IC chips 56*a,* 56*b,* and 56*c*.

Figure 7:
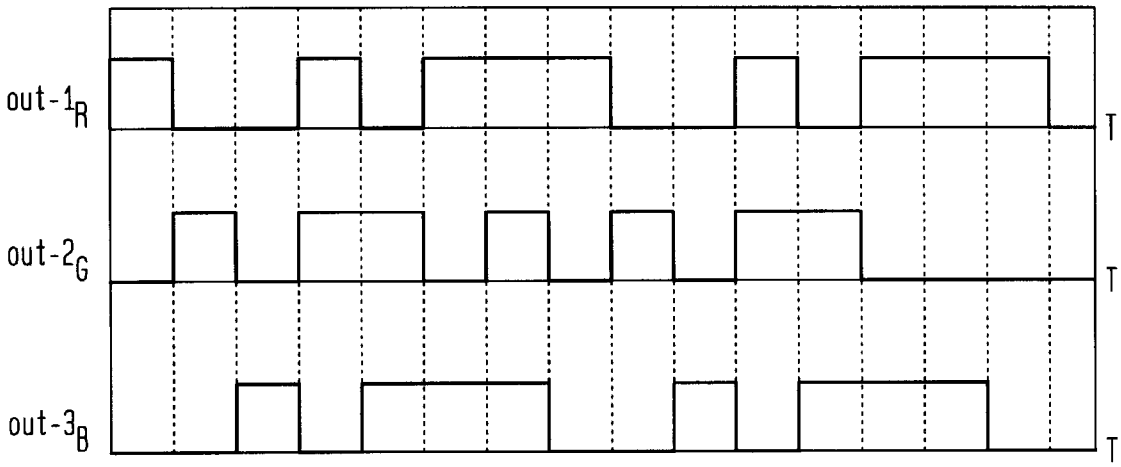
FIG. 7 is a time schedule diagram of the LED control signals.

A typical time schedule of the control information from the programmable controller U1 is illustrated in FIG. 7. The four (4) LED 56 IC chips are sealed together is eproxy and lead to a positive terminal and a negative terminal from battery 60. The lights seen from points 54 will typically change in a rotating fashion from red to green to blue to red to green to green+blue to blue+red to red+green+blue, etc. when the LED 56 is connected to the power source 60 through switch 62. According to chromatography theory, red, green and/or blue can be combined into seven (7) colors. Each set of colors is displayed for about 4–5 seconds according to the preferred embodiment. Other displays are possible also. Certainly, other IC chips 56 can be acquired for different displays.

The invention 10 includes a number of unique features.

First, the transparent cover 36 collects all the fiber optic strands 46 and gathers them into a single bundle at the first ends thereof 48, which in turn is sealed within the glass globe 12. The inner cover 36, connected to LED lights 56*a,* 56*b,* and 56*c,* bring all the lights to and through it. By employing the cover structure 36, light can be transmitted to the inner top 52 of the sealed water globe 10 so that the fiber optic strands of the bundle 46 can pass safely therethrough.

Second, the combination of the structure of the water globe 10 with the LED lights 56*a,* 56*b* and 56*c* is unique. Small and attractive interior structures can be added to the water globe 10, such as replacing the inner top 52 with a Christmas scene, Santa Clause, a crèche, etc. Additional decorations can be added along with the inner top 52. This combination structure allows light to be transmitted to the inner top 52 of the water globe 10 without increasing the original, i.e., standard, size of the water globe structure.

Third, the invention 10 includes a number of alternative embodiments, such as the use of AC or DC power, the possibility of switch or sound activation, the possibility of light or shadow activation, the use of different designs or different materials, etc.

While the invention has been described with reference to the preferred embodiment thereof, it will be appreciated by those of ordinary skill in the art that various changes and modifications can be made to the structure and materials that comprise the invention without departing from the spirit and scope of the invention as a whole.

We claim:

1. A liquid filled globe apparatus comprising:

a base;

a substantially clear globe having an aperture therein;

a light source;

a power source connected to said light source:

a plurality of fiber optic fibers each having a first end and a second end and wherein said first end of said fiber optic fibers is exposed to said light source;

an inner top means for supporting said second ends of said fiber optic fibers and permitting said light from said light source to shine through said second end;

liquid impervious seal means for sealing said globe to said base; and, a liquid for filling said globe, wherein said light appears to emanate from said inner top means.

2. The apparatus of claim 1 further comprising:

an electronic controller for controlling the illumination of said light source.

3. The apparatus of claim 2 wherein said light source comprises a light emitting diode (LED).

4. The apparatus of claim 3 further comprising:

a speaker means attached to said controller and said power source for providing music to accompany the illumination of said LED.

5. The apparatus of claim 4 further comprising:

a switch means located on the outside of said base for selectively providing power to said controller means.

6. The apparatus of claim 5 wherein said seal means further comprises:

a circular resilient seal that fits within the aperture of said globe, said resilient seal having a circular downwardly extending sidewall that contacts said globe and a substantially flat portion perpendicular to said sidewall section, said flat portion including an aperture therein; and, a cover means that fits within said aperture in said circular resilient seal.

7. The apparatus of claim 6 wherein said cover means further comprises:

a well means having a closed bottom portion in the center thereof for receiving said first ends of said fiber optic fibers.

8. The apparatus of claim 7 further comprising:

a sleeve means for attaching said LED to said bottom portion of said well means so that said LED is in close, but sealed proximity to the first ends of said fiber optic fibers so that said first ends receive substantially direct light input from said LED.

9. The apparatus of claim 8 wherein said LED is capable of generating at least two different colors of light in response to control signals from said controller.

10. The apparatus of claim 9 wherein said controller coordinates the music played by said speaker means with the light displayed through the second ends of said fiber optic fibers.

* * * * *